US006161614A

United States Patent [19]

Woodhull, Jr. et al.

[11] Patent Number: 6,161,614

[45] Date of Patent: Dec. 19, 2000

[54] ALUMINUM HEADER CONSTRUCTION

[75] Inventors: Ivan D. Woodhull, Jr., Southgate; Kenneth McIver, Trenton; Richard Warlick, Jr., Brownstown; Jerry Phelps, Wyandotte; Rial Hamann, Grosse Ile, all of Mich.

[73] Assignee: Karmazin Products Corporation, Wyandotte, Mich.

[21] Appl. No.: 09/266,783

[22] Filed: Mar. 12, 1999

Related U.S. Application Data

[63] Continuation-in-part of application No. 09/049,742, Mar. 27, 1998.

[51] Int. Cl.[7] ..... F28D 1/00

[52] U.S. Cl. ..... 165/149; 165/148; 165/144; 165/173; 165/178; 165/297

[58] Field of Search ..... 165/144, 101, 165/297, 176, 173, 140, 149, 178, 153, 148; 29/890.03; 123/41.1, 196 AB

[56] References Cited

U.S. PATENT DOCUMENTS

| | | | |
|---|---|---|---|
| 1,799,691 | 4/1931 | Karmazin . | |
| 1,810,215 | 6/1931 | Karmazin . | |
| 2,044,457 | 6/1936 | Young . | |
| 2,704,929 | 3/1955 | Day et al. | 165/144 |
| 3,515,208 | 6/1970 | Karmazin . | |
| 3,782,454 | 1/1974 | Slaasted et al. | 165/144 |
| 4,141,409 | 2/1979 | Woodhull, Jr. et al. . | |
| 4,209,062 | 6/1980 | Woodhull, Jr. . | |
| 4,381,033 | 4/1983 | Woodhull, Jr. et al. . | |
| 4,422,500 | 12/1983 | Nishizaki et al. . | |
| 4,448,242 | 5/1984 | Andres et al. | 165/48 |
| 4,669,532 | 6/1987 | Tejima et al. . | |
| 4,962,809 | 10/1990 | Belcher . | |
| 5,176,200 | 1/1993 | Shinmura . | |
| 5,275,231 | 1/1994 | Kuze . | |
| 5,303,770 | 4/1994 | Dierbeck . | |
| 5,383,517 | 1/1995 | Dierbeck . | |
| 5,423,373 | 6/1995 | Ramberg . | |
| 5,529,117 | 6/1996 | Voss et al. . | |
| 5,562,157 | 10/1996 | Hasegawa et al. . | |
| 5,685,366 | 11/1997 | Voss et al. . | |

FOREIGN PATENT DOCUMENTS

| | | |
|---|---|---|
| 662841 | 8/1929 | France . |

*Primary Examiner*—Ira S. Lazarus
*Assistant Examiner*—Terrell McKinnon
*Attorney, Agent, or Firm*—Harness, Dickey & Pierce, P.L.C.

[57] ABSTRACT

A heat exchanger is provided including a first aluminum extruded header spaced apart and arranged essentially parallel to a second aluminum extruded header. The first and second headers include a plurality of parallel passageways extending therethrough along a longitudinal axis thereof. The passageways are fluidly interconnected by at least one transverse cross-drilled bore extending essentially perpendicularly to the longitudinal axis. A core assembly is secured between the first and second headers including a plurality of fluid conduits and heat radiating fins surrounding the fluid conduits. A by-pass valve assembly fluidly communicates with the headers and core assembly while providing an alternate pathway independent thereof. Preferably, the by-pass assembly is responsive to fluid temperature and/or pressure for directing fluid flow either into or exterior of the heat exchanger core assembly. In one form the by-pass valve assembly is fixedly secured to one of the headers whereas in a second embodiment the by-pass valve assembly is removably secured to a plate member secured to one of the headers.

31 Claims, 4 Drawing Sheets

ALUMINUM HEADER CONSTRUCTION

CROSS REFERENCE TO RELATED APPLICATION

This is a continuation-in-part application of U.S. Ser. No. 09/049,742, filed Mar. 27, 1998.

BACKGROUND OF THE INVENTION

1. Technical Field

The present invention relates generally to heat exchangers and, more particularly, to such heat exchangers having an aluminum extruded header construction and a temperature responsive by-pass assembly.

2. Background

Heat exchangers of the fin and tube type are employed for cooling or otherwise transferring heat between two fluids. Generally, one of the fluids is circulated internally through conduits provided in the heat exchanger core and the other is passed over the exterior of the conduits and associated heat radiating fins. Such heat exchangers are commonly employed in heavy construction machinery as well as other apparatus for use in cooling oil, hydraulic fluid or the like.

In such applications, the fluid may exert a high level of pressure on the heat exchanger and has the potential for subjecting the heat exchanger to even higher pressure spikes. The pressurized fluid may damage the header portion or core portion of the heat exchanger if either portion is not designed properly.

Further, the fluid may have a relatively high viscosity when cool such as at start-up of the equipment and become thinner as it is warmed during use. This high viscosity may cause higher than desired pressure in the inlet header of such heat exchangers due to the viscous resistance of fluid flow through the relatively small passages in the heat exchanger core. Also, the resistance may prevent a sufficient amount of fluid from being circulated through the system which in an extreme case could result in excessive equipment wear.

In view of the foregoing, it would be desirable to provide an extruded header for a heat exchanger for withstanding extreme internal pressure. It would also be desirable to provide a temperature responsive by-pass means to allow the cool high viscosity to by-pass the heat exchanger core. Such a by-pass means may also operate to prevent unnecessary cooling of the fluid thereby assisting the apparatus in reaching a steady state operating temperature more rapidly.

SUMMARY OF THE INVENTION

The above and other objects are provided by a heat exchanger including a first extruded aluminum header spaced apart and arranged essentially parallel to a second extruded aluminum header. The first and second headers include a plurality of parallel passageways extending therethrough along a longitudinal axis. The passageways are fluidly interconnected by at least one cross-drilled transverse bore extending essentially perpendicularly to the longitudinal axis. A core assembly is secured between the first and second headers and includes a plurality of restricted fluid conduits and heat radiating fins surrounding the fluid conduits. An optional valved by-pass assembly fluidly communicates with the headers and core assembly while providing an alternate pathway independent thereof. Preferably, the by-pass assembly is responsive to fluid temperature for directing fluid flow either into or exterior of the heat exchanger core assembly.

BRIEF DESCRIPTION OF THE DRAWINGS

In order to appreciate the manner in which the advantages and objects of the invention are obtained, a more particular description of the invention will be rendered by reference to specific embodiments thereof which are illustrated in the appended drawings. Understanding that these drawings only depict preferred embodiments of the present invention and are not therefore to be considered limiting in scope, the invention will be described and explained with additional specificity and detail through the use of the accompanying drawings in which:

FIG. 6 is a fragmentary front elevational view similar to that of FIG. 1 but illustrating an alternate embodiment of the present invention including a temperature responsive by-pass assembly provided thereon;

DETAILED DESCRIPTION OF THE PREFERRED EMBODIMENTS

The present invention is directed towards a heat exchanger suitable for withstanding elevated pressures of the fluid contained therein. The heat exchanger includes a pair of oppositely disposed and spaced apart aluminum extruded headers including a plurality of parallel passageways extending therethrough along a longitudinal axis. The passageways are fluidly interconnected by at least one cross-drilled transverse bore extending essentially perpendicular to the longitudinal axis. An optional by-pass assembly fluidly communicates with the first header while providing an alternate pathway independent thereof. In a preferred embodiment of the present invention, the by-pass assembly includes a temperature responsive by-pass valve. As such, high viscosity and low temperature fluid is allowed to by-pass the core of the heat exchanger thereby reducing the time required for the fluid to reach a normal operating temperature.

Figure 1:
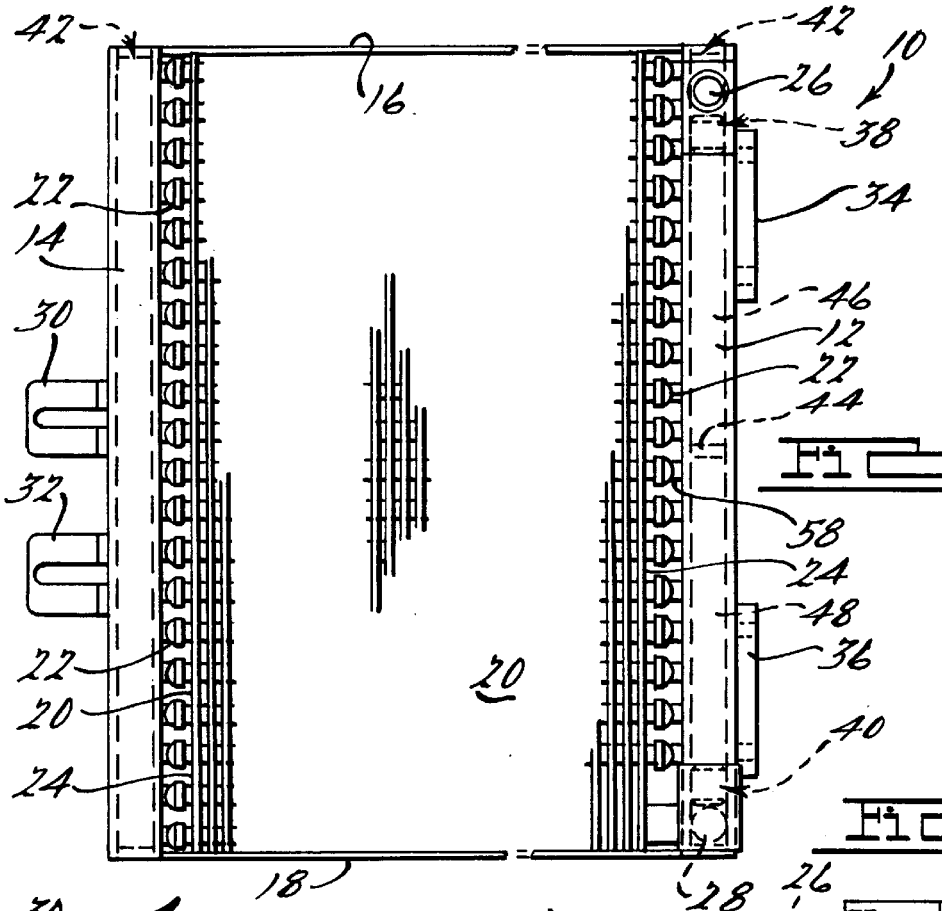
FIG. 1 is a front elevational view of a heat exchanger according to the present invention having an aluminum extruded header including a plurality of parallel passageways extending longitudinally therethrough interconnected by at least one transverse bore all in accordance with the present invention.

Turning now to the drawing Figures, a first preferred embodiment of heat exchanger 10 in accordance with the present invention is illustrated in FIG. 1. The heat exchanger 10 includes a first header 12, a second header 14 spaced from the first header 12 and arranged in substantially parallel relationship therewith. A pair of spaced apart frame members 16 and 18 extend therebetween adjacent opposite ends of the first and second headers 12 and 14. A heat exchanger core assembly 20 is disposed between first and second headers 12 and 14 and is in fluid communication therewith. The core assembly includes a plurality of relatively small diameter fluid conduits 22 extending generally perpendicular to the longitudinal axis of the first and second headers 12 and 14. The fluid conduits 22 are surrounded by a plurality of fins 24 extending substantially parallel to the longitudinal axis of the first and second headers 12 and 14. Preferably, core assembly 20 will be of the stacked fin and tube type such as disclosed in U.S. Pat. Nos. 3,430,692 and 3,601,878, the disclosures of which are hereby incorporated by reference. The first header 12 has an inlet opening 26 adjacent one end thereof which is adapted to be connected to a fluid supply line (not shown). The first header 12 has a similar outlet opening 28 adapted to be connected to a discharge line (also not shown).

Figure 2:
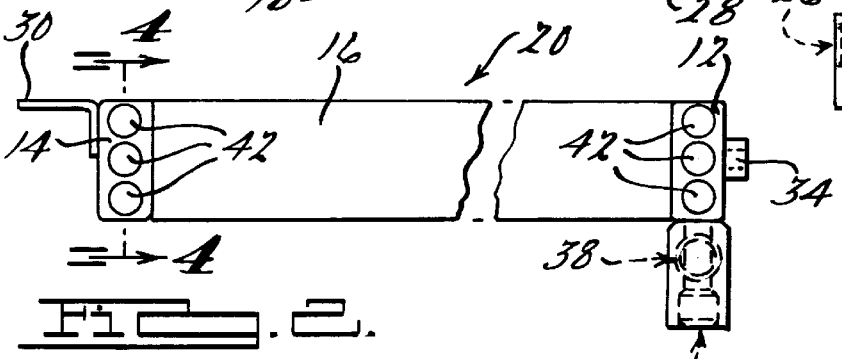
FIG. 2 is an end view of the heat exchanger of FIG. 1.
Figure 3:
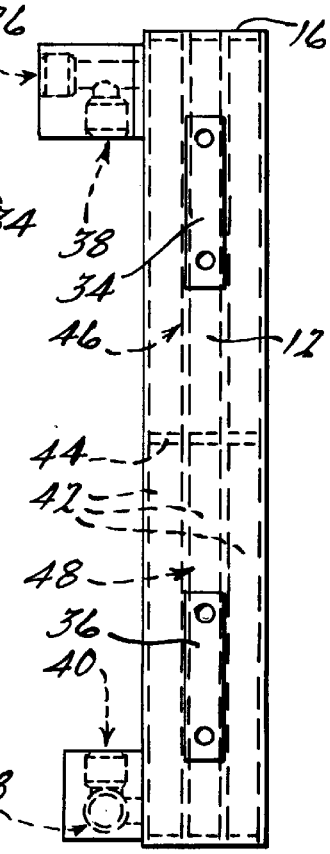
FIG. 3 is a side elevational view of the heat exchanger of FIG. 1 illustrating the passageways in phantom.

Referring now also to FIGS. 2 and 3, a pair of L-shaped elbow mounting brackets 30 and 32 are fixed by welding or other conventional means to an outboard edge of the second header 14. Similarly, a pair of mounting brackets 34 and 36 are fixed by welding or other conventional means to an outboard edge of the first header 12.

Still referring to FIGS. 1–3, the first and second headers 12 and 14 include three parallel passageways 42 extending essentially parallel to the longitudinal axis of the first and second headers 12 and 14. The passageways 42 fluidly interconnect the inlet opening 26 and outlet opening 28 via the headers 12 and 14 and the core assembly 20. Preferably, each of the headers 12 and 14 are formed from aluminum through an extrusion process. The extruded aluminum stock having the desired number of longitudinally extending fluid passages 42 is easily cut to the desired length required for the intended heat exchanger and the opposite ends thereof are closed off by welding suitable plates thereto. Because the respective passages 42 are interconnected via bores 50, exchange therebetween at the end plates is not of concern. Additionally, when constructing a two pass heat exchanger such as that shown in FIGS. 1–3, two substantially equal lengths of header stock are joined together with a divider plate 44 welded therebetween. Alternatively, it may be possible to extrude header 12 in such a manner as to form divider plate 44 integrally therewith if desired. As such, the conduits 42 of the first header 12 are divided into supply conduits 46 proximate the inlet opening 26 and discharge conduits 48 proximate the outlet opening 28.

Figure 5:
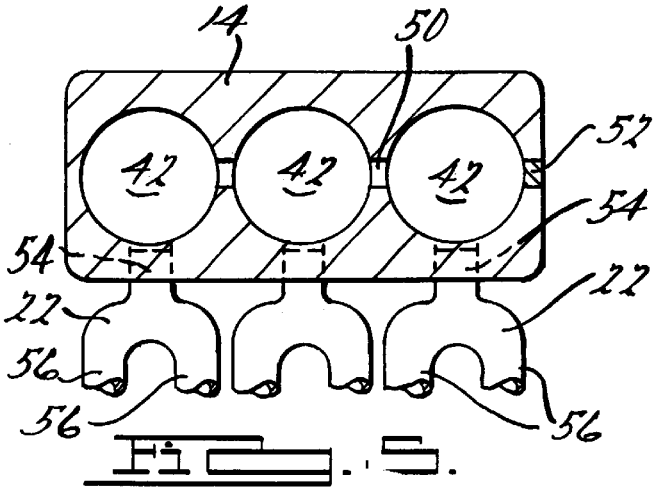
FIG. 5 is a sectional view of the heat exchanger of the present invention taken along line 5—5 of FIG. 4.
Figure 4:
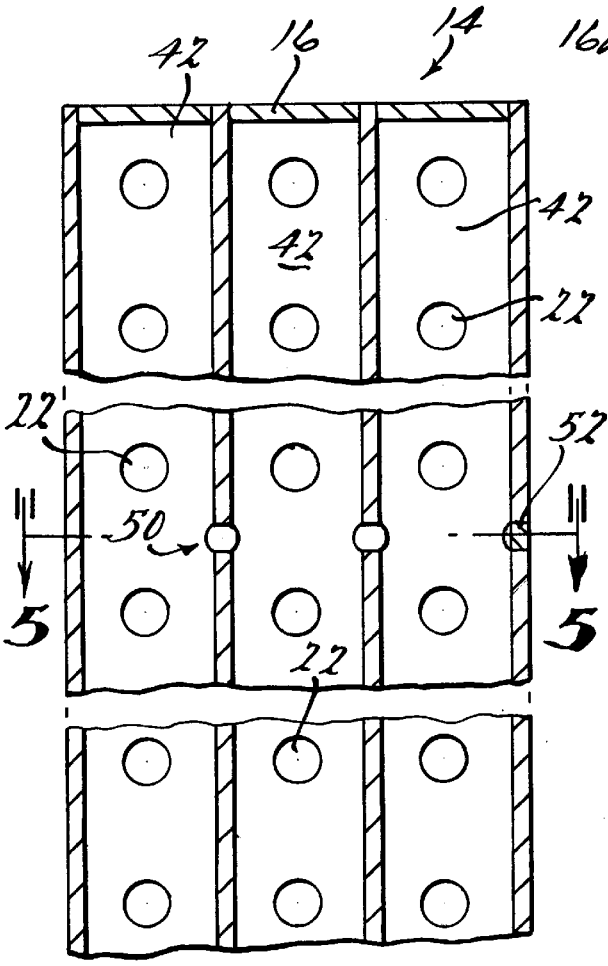
FIG. 4 is a sectional view of the heat exchanger of the present invention taken along line 4—4 of FIG. 2.
Figure 5:
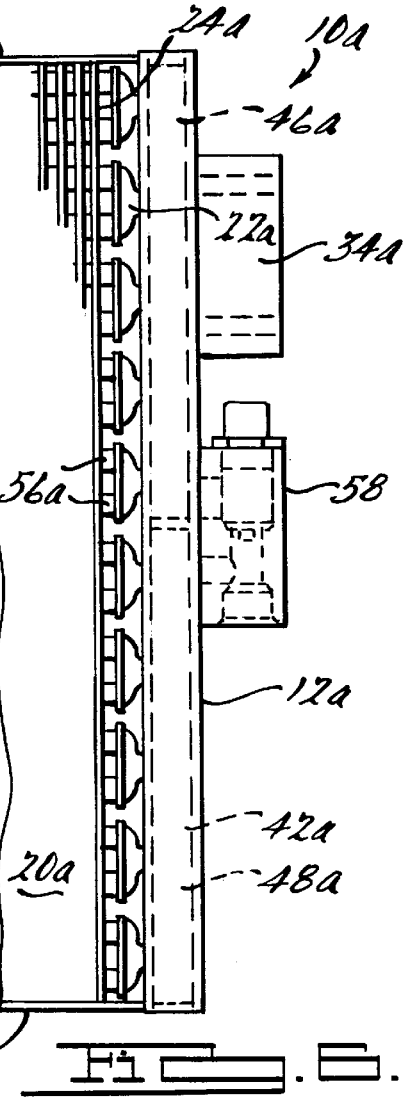

Referring now to FIGS. 4 and 5, a more detailed view of the second header 14 is provided. While the following description is directed towards the second header 14, one skilled in the art will appreciate that, with the exception of the divider 44, the first header 12 is substantially similar to the second header 14 and that the following description applies equally thereto. Each of the passageways 42 of the second header 14 is in fluid communication with an adjacent passageway 42 by way of a transverse bore 50 extending essentially perpendicularly to the longitudinal axis of the second header 14. Preferably, the transverse bore 50 is formed by cross-drilling the extruded second header 14. The end of the transverse bore 50 at the outboard edge of the second header 14 is sealed by a suitable plug 52 welded in place to prevent leakage of the second header 14.

Each of the conduits 42 fluidly communicates with a plurality of the fluid conduits 22 arranged perpendicularly thereto and which form a part of the core assembly. As best seen in FIG. 5, each of the fluid conduits 22 includes an inlet 54 bifurcated into a pair of parallel pipes 56 which extend through the core assembly 20 to the first header 12 (see FIG. 1). Although not illustrated in detail, one skilled in the art will appreciate that the pair of parallel pipes 56 reconverge at an opposite end into a single outlet 58 (FIG. 1) communicating with the first header 12. It should be appreciated that the terms inlet and outlet as used herein are interchangeable and are merely indicative of the direction of fluid flow. In the embodiment illustrated in FIG. 5, the plane defined by the pair of parallel pipes 56 is parallel to the frame members 16 and 18 thereby allowing inclusion of a greater number of flow paths between the two headers for a given envelope size. As such, a short and wide heat exchanger may be provided while still providing significant surface area for heat exchange.

In operation, fluid such as oil is supplied to the inlet opening 26 via a supply line and enters into the supply passageways 46 of the first header 12. Upon the fluid entering the first of the supply passageways 46 (i.e., the passageway 46 communicating with inlet opening 26) the fluid fills the remaining supply passageways 46 in the first header 12 by propagating through one or more transverse bores 50. This propagation can be controlled (i.e., enhanced or reduced) by changing the diameter and/or number of transverse bores 50 provided therein, although it is preferred to incorporate a sufficient number and/or sufficiently large diameter bores to insure substantially free flow between and equal pressure in each of the passages 42.

From the supply passageways 46, the fluid propagates through the fluid conduits 22 in communication therewith to the second header 14. Upon entering the second header 14, the fluid fills passageways 42 formed therein via the transverse bore 50. The fluid then propagates from the second header 14, through the remaining fluid conduits 22 to the discharge passageways 48 formed in the first header 12. From the discharge passageways 48, the fluid is discharged from the heat exchanger 10 through the outlet opening 28 and a discharge line coupled therewith. As the fluid traverses the conduits 22 of the core assembly 20, its temperature is reduced as heat is conducted and convected from the fluid to the walls of the conduits 22 and to the fins 24.

It should be noted that heat exchanger 10 as illustrated and described is a two pass heat exchanger (i.e., the fluid flows through the core twice). However, if desired heat exchanger 10 may be easily fabricated as a single pass heat exchanger by merely deleting divider 44 from header 12 and moving the outlet fitting 28 to the other header 14. Alternatively, a multiple pass heat exchanger may be easily fabricated by providing any number of dividers 44 appropriately positioned in each of headers 12 and 14.

Turning now to FIG. 6, an alternate embodiment of the present invention is illustrated. This embodiment is substantially similar to the embodiment depicted in FIGS. 1–5 with the exception that the plurality of fluid conduits **22*a* including the pairs of parallel pipes 56*a* have been rotated by 90° relative to horizontal such that the plane defined by the pair of parallel pipes 56*a* is perpendicular to the frame members 16*a* and 18*a*. This arrangement is preferred, as it enables the longitudinal spacing between openings 22 to be increased. Further, the inlet opening 26, outlet opening 28 and the by-pass openings 38 and 40 of the first embodiment have been combined into a by-pass valve assembly 58. The by-pass valve 58 is operable for directing fluid flow into or independent of the heat exchanger 10***a* in response to either the pressure or temperature of the fluid, or both.

Figure 7:
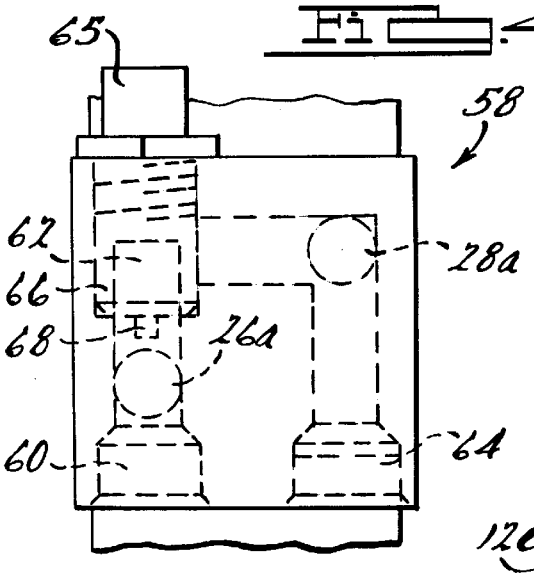
FIG. 7 is an enlarged fragmentary detail view of the by-pass assembly of FIG. 6.

As best seen in FIG. 7, the temperature and pressure responsive by-pass valve assembly 58 includes a by-pass valve inlet 60 fluidly communicating with the inlet opening 26*a* and a valve chamber 62. Similarly, the by-pass valve assembly 58 includes a by-pass valve outlet 64 fluidly communicating with the outlet opening 28*a* and the valve chamber 62. A thermally responsive valve 65 is disposed within the valve chamber 62 and includes a valve member 66 operable to open and close the passageway defined between the inlet 60 and outlet 64. The valve 65 is preferably of the type which includes a wax motor operable to drive the valve member 66 into a position such that communication between inlet 60 and outlet 64 via valve chamber 62 is prevented when the fluid exceeds a predetermined temperature. The wax motor is positioned in the fluid flow path through chamber 62 so as to be directly responsive to the fluid temperature. Additionally, valve 65 may include a biasing spring operable to resiliently bias valve member 66 into a closed position but allow communication between inlet 60 and outlet 64 via chamber 62 when valve member 66 is moved into an open position in response to an increase in the differential pressure between inlet 60 and outlet 64 above a predetermined level.

When the by-pass valve 65 is open, fluid enters the by-pass valve inlet 60 from a supply line and propagates through the valve chamber 62 and exits through the by-pass valve outlet 64. Although the inlet opening 26*a* is open in this mode, the majority of fluid bypasses the fluid opening 26*a* due to the restricted fluid flow permitted through the opening 26*a* as well as the added flow resistance from core 20. Thus, since the passageway through the by-pass valve 58 provides the path of least resistance, the fluid travels therethrough and bypasses the heat exchanger 10.

On the other hand, when the by-pass valve 65 is closed, i.e., the valve member 66 engages the valve seat, the fluid travels through the by-pass valve inlet 60 and into the inlet opening 26*a*. After passing through the first header 12, core assembly 20, second header 14 and returning to the first header 12, the fluid propagates through the outlet opening 28*a* and exits the by-pass valve outlet 64 to a discharge line. Thus, when the fluid is insufficiently warm (and thus too viscous) it may be directed away from the heat exchanger 10.

Figure 8:
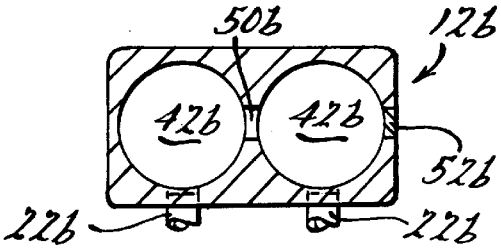
FIG. 8 is a sectional view similar to that of FIG. 5 but illustrating an alternate embodiment thereof.

Turning now to FIG. 8, an alternate embodiment header, such as first header 12*b*, is illustrated. Although the first header 12*b* is illustrated, it can be appreciated that the second header 14 could readily substitute therefore. As opposed to the previous embodiments, the first header 12*b* includes two enlarged diameter parallel passageways 42*b* extending therethrough along the longitudinal axis. The passageways 42*b* communicate with conduits 22*b* and are interconnected by a transverse bore 50*b* which is sealed with a suitable plug 52*b*. Accordingly to this embodiment, a more narrow header 12*b* is provided.

Figure 9:
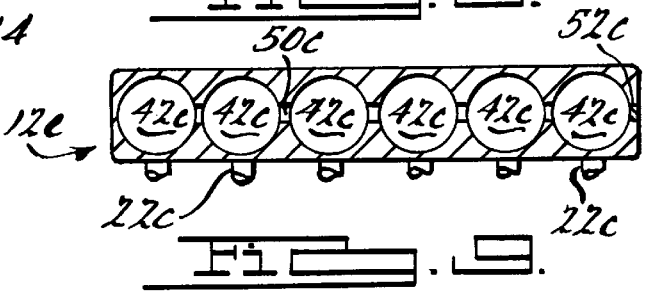
FIG. 9 is a sectional view similar to that of FIGS. 5 and 8 but illustrating another embodiment thereof.

Still yet another embodiment of the present invention is illustrated in FIG. 9. In this embodiment, a header, such as first header 12*c*, includes six relatively smaller diameter parallel passageways 42*c* extending therethrough along the longitudinal axis. The passageways 42*c* are fluidly interconnected by a transverse bore 50*c* sealed at an outboard edge of the header 12*c* with a suitable plug 52*c*. The passageways 42*c* also communicate with the conduits 22*c*. As can be appreciated, the embodiments illustrated in FIGS. 5, 8 and 9 demonstrate that the number and diameter of passageways 42*c* in the header 12*c* can be controlled by a designer according to the particular needs of the application into which the present invention is incorporated, such as, fluid viscosity, and available space as well as required cooling capacity. For instance, the embodiment illustrated in FIG. 9 is well suited for use in a wide but, perhaps, short space.

Figure 10:
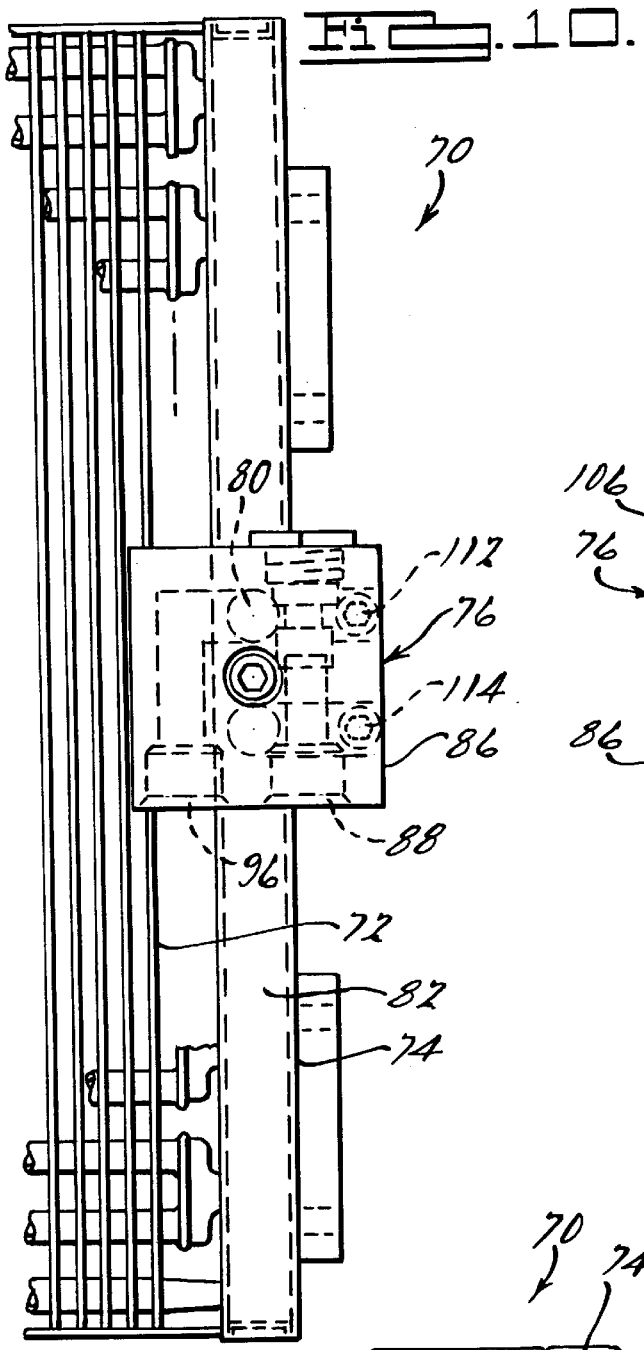
FIG. 10 is a view similar to that of FIG. 6 but showing another embodiment of the present invention.
Figure 11:
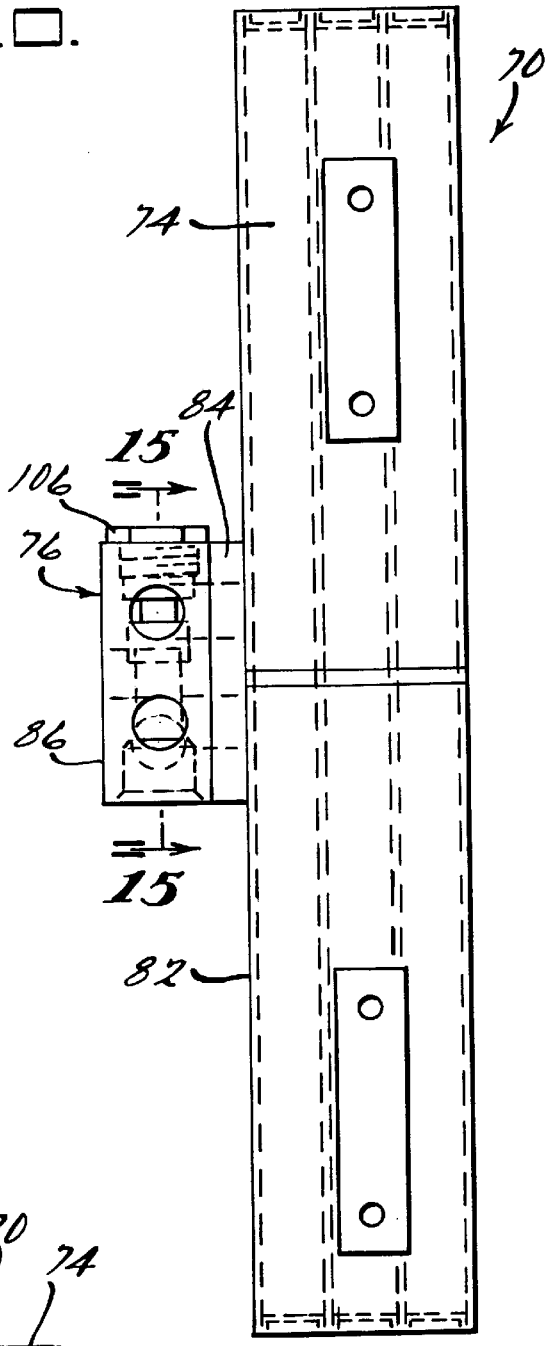
FIG. 11 is a view similar to that of FIG. 3 but showing the embodiment of FIG. 10.
Figure 12:
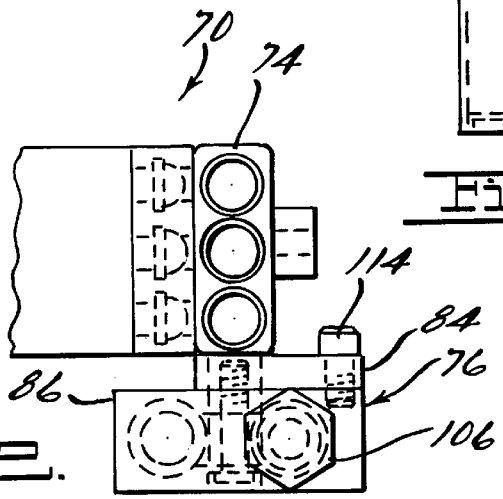
FIG. 12 is an end view of the embodiment of FIG. 10.
Figure 13:
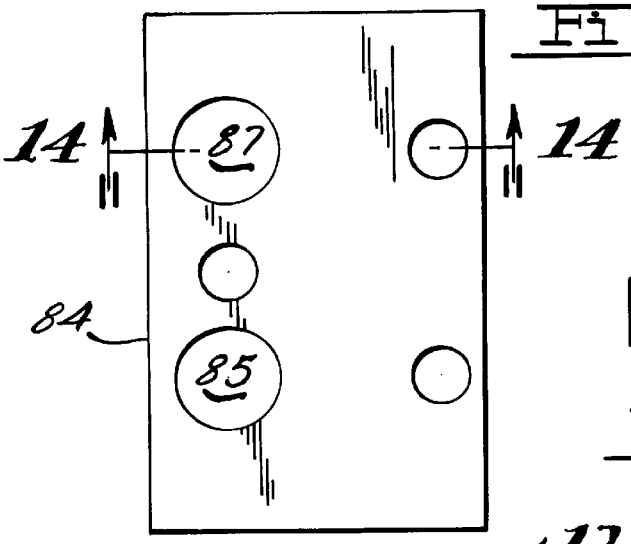
FIG. 13 is an enlarged elevational view of the plate member to which the valve housing is secured.
Figure 14:
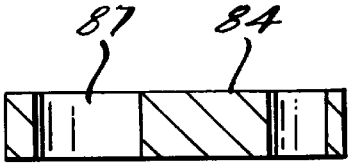
FIG. 14 is a section view of the plate member shown in FIG. 13, the section being taken along line 14—14 thereof.
Figure 15:
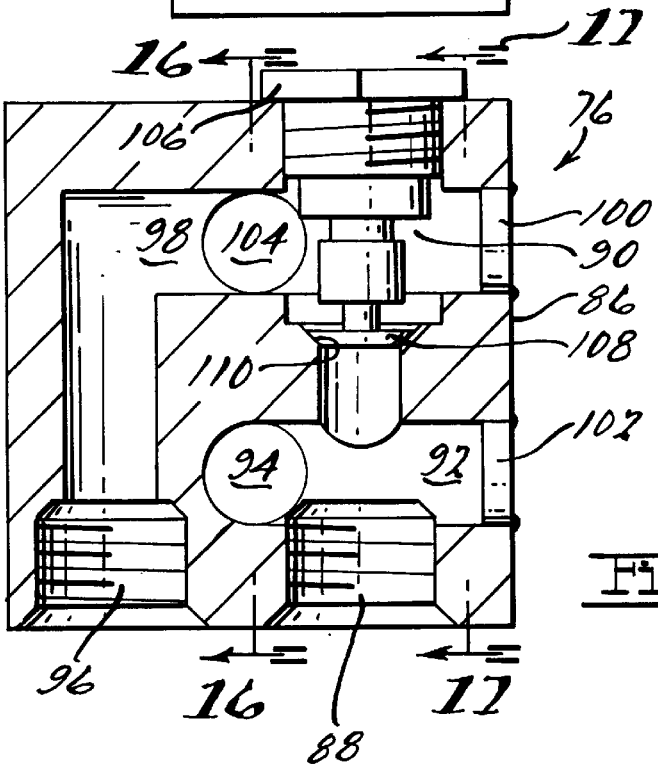
FIG. 15 is a section view of the by-pass valve housing, the section being taken along line 15—15 of FIG. 11.
Figure 16:
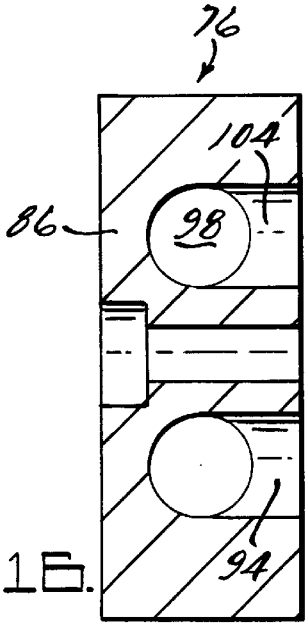
FIG. 16 is another section view of the valve housing of FIG. 15, the section being taken along line 16—16 thereof.
Figure 17:
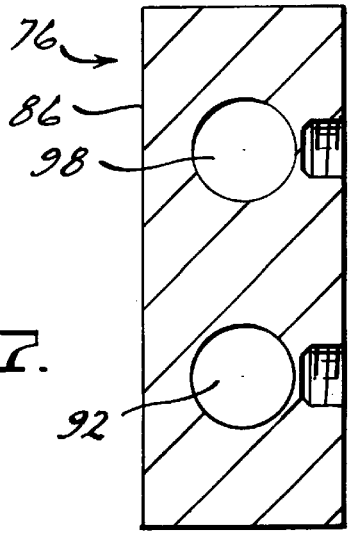
FIG. 17 is another section view of the valve housing of FIG. 15, the section being taken along line 17—17.

Another embodiment of the present invention is shown in and will be described with reference to FIGS. 10–12. In this embodiment, heat exchanger 70 is a two pass heat exchanger, is generally similar to heat exchangers 10 and 10*a* described above, and includes a core assembly 72 preferably of the stacked fin and tube type having a pair of headers secured to opposite ends thereof (only the inlet/outlet header 74 being shown). Header 74 and the return header (not shown) are of the extruded construction described above, with header 74 being substantially identical to header 12*a* except for the positioning and manner of attachment of the by-pass valve assembly 76 and the location of the inlet and outlet openings provided therein.

As shown, inlet and outlet openings 78 and 80 are provided in close proximity to each other in the sidewall portion 82 of header 74. A plate member 84 is secured to sidewall portion 82 and includes a pair of spaced openings 85, 87 therein which are positioned in aligned relationship to respective inlet and outlet openings 78 and 80. Preferably, plate member 84 will be secured to sidewall portion 82 so as to form a fluid-tight connection therewith such as by welding although other suitable means for securing plate 84 thereto may be utilized.

By-pass valve assembly 76 is generally similar to by-pass valve assembly 58 and includes a housing 86 having an inlet passage 88 which opens into a valve chamber 90 provided in housing 86. A transversely extending passage 92 intersects inlet passage 88 and opens at its inner end to a laterally extending passage 94 which in turn opens outwardly of housing 86 in a position so as to be aligned with opening 85 in plate member 84 when housing 86 is secured thereto. An outlet opening 96 is also provided extending inwardly in substantially parallel spaced relationship to inlet passage 92 and opening at its inner end into a transversely extending passage 98. Transversely extending passage 98 extends through valve chamber 90 and has its outer end sealed by means of a suitable plug 100. In similar fashion, the outer end of transversely extending passage 92 is also sealed by means of a suitable plug 102. A laterally extending passage 104 extends in parallel spaced relationship to laterally extending passage 94 from transversely extending passage 98 and opens outwardly of housing 86 in a position so as to be aligned with opening 87 in plate member 84 when housing 86 is secured thereto. A valve member 106 is removably secured in housing 86 and extends into valve chamber 90. Valve member 106 includes a valve element 108 engageable with a valve seat 110 positioned at the juncture between inlet passage 88 and valve chamber 90 to prevent fluid communication between inlet passage 88 and valve chamber 90. Preferably, valve member 106 will be substantially identical to valve 65 disclosed above and will include a wax motor operative to move valve element between open and closed positions in response to the temperature of the fluid flowing through heat exchanger 70.

Housing 86 is preferably removably secured to plate member 84 by means of a plurality of threaded fasteners 112, 114 and 116. Suitable O-rings may be utilized at the juncture of passages 94 and 104 with passage 87 and 85 in plate member 84 so as to ensure a secure fluid-tight sealing relationship therebetween.

In operation, a fluid supply line is connected to inlet opening 88 and a fluid discharge line is connected to outlet opening 96. When operation of the equipment on which the heat exchanger is installed is begun and the fluid is cold, the wax motor of valve member 106 will have operated to move valve element 108 off seat 110 thereby enabling fluid to flow directly from inlet 88 to outlet 96 via valve chamber 90 thus bypassing the core assembly 72. As the fluid begins to warm during continued operation, valve member 106 will begin to close thereby increasing the restriction on flow through valve chamber 90 which will result in increasing volume of fluid being directed through heat exchanger core 72. Once the temperature of fluid has increased to the desired operating level, valve 106 will fully close thereby directing all fluid flow through the heat exchanger core. The wax motor of valve 106 is positioned so as to be able to continuously sense the temperature of fluid as it leaves the heat exchanger core and thus should for some reason the temperature thereof decrease below the desired level, valve element 108 will be opened again to enable some fluid to bypass the core assembly thus reducing the cooling thereof. It should be noted that valve member 106 may also operate to provide a pressure responsive bypass feature as well. Thus should, for some reason, the pressure drop through the core assembly as sensed between the inlet and outlet rise above a predetermined level, this pressure differential will operate to open valve element 108 to allow fluid to bypass the core assembly thus enabling continued operation of the equipment.

It should be noted that while the embodiment of FIGS. 10–17 has been shown and described utilizing a header having three fluid passages, headers having a greater or less number of fluid passages may be easily substituted therefor.

The use of a removably secured valve assembly as described above offers the advantage of increased flexibility as well as reduced down time in the event of a malfunction. For example, should for some reason it become desirable to remove the by-pass valve assembly due to some operating concerns, valve housing 86 may be easily removed by removing the retaining fasteners 112, 114, 116. Thereafter, a second plate having suitable openings for connection of the inlet and outlet fluid lines can be substituted for the valve housing 86 and the equipment then operated without the by-pass feature. Likewise, should for some reason valve member 106 malfunction, the entire assembly can be easily replaced or should a replacement valve member not be available, a suitable second plate without the by-pass arrangement can be installed in place thereof. Additionally, the modular valve housing arrangement described above may facilitate fabrication of the heat exchanger in that the entire heat exchanger can be assembled and subject to an oven brazing process to ensure a fluid-tight seal between the various components after which the valve assembly can be easily assembled thereto.

Thus, the present invention provides a heat exchanger including aluminum extruded headers having a plurality of parallel passageways extending therethrough along a longitudinal axis. The parallel passageways are fluidly interconnected by a transverse bore cross-drilled through the header. A by-pass valve outboard of the heat exchanger provides a fluid passageway independent of the heat exchanger core assembly. In a preferred embodiment, the by-pass valve is responsive to the temperature and pressure of the fluid traveling therethrough.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification, and following claims.

We claim:

1. A heat exchanger comprising:

a one piece first header including a plurality of parallel passageways extending therethrough along a longitudinal axis, each of said passageways being fluidly interconnected by at least one transverse bore extending essentially perpendicularly to said longitudinal axis;

a one piece second header spaced apart from said first header and including a plurality of parallel passageways extending therethrough along a longitudinal axis, each of said passageways being fluidly interconnected by at least one transverse bore extending essentially perpendicularly to said longitudinal axis; and a separate core assembly secured between said first and second headers, said core assembly including a plurality of fluid conduits extending between said plurality of passageways of first header and said plurality of passageways of said second header and heat radiating fins surrounding said plurality of fluid conduits.

2. The heat exchanger of claim 1 wherein said first and second headers further comprise extruded aluminum members.

3. The heat exchanger of claim 1 wherein said transverse bores further comprise lateral passageways cross-drilled through said first and second headers.

4. The heat exchanger of claim 1 further comprising a by-pass mechanism providing a passageway into and independent of said core assembly.

5. The heat exchanger of claim 4 wherein said by-pass mechanism includes a valve housing, said valve housing being removably secured to one of said first and second headers.

6. The heat exchanger of claim 4 wherein said by-pass mechanism further comprises a by-pass valve responsive to temperature for changing between an open and closed mode.

7. The heat exchanger of claim 1 wherein said first header is bifurcated into a plurality of parallel supply conduits and a plurality of parallel discharge conduits.

8. The heat exchanger of claim 1 wherein said fluid conduits further comprise an inlet and an outlet and a pair of parallel pipes extending therebetween.

9. The heat exchanger of claim 8 wherein said pair of parallel pipes form a plane perpendicular to a plane defined by a pair of frame members extending between ends of said first and second headers.

10. The heat exchanger of claim 8 wherein said pair of parallel pipes form a plane parallel to a plane defined by a pair of frame members extending between ends of said first and second headers.

11. The heat exchanger of claim 1 wherein said transverse bores are sealed at an outboard edge of said headers by a plug.

12. The heat exchanger of claim 1 wherein said plurality of parallel passageways further comprise two parallel passageways.

13. The heat exchanger of claim 1 wherein said plurality of parallel passageways extending through said first and second headers further comprise three parallel passageways.

14. The heat exchanger of claim 1 wherein said plurality of parallel passageways further comprise six parallel passageways.

15. A heat exchanger comprising:

a first integrally formed header including a first plurality of parallel passageways extending therethrough along a longitudinal axis, said passageways being fluidly interconnected by at least one transverse bore extending essentially perpendicularly to said longitudinal axis and a plurality of second passages opening outwardly along one side of said headers from each of said first plurality of passageways;

a second integrally formed header spaced apart from said first header and including a plurality of third parallel passageways extending therethrough along a longitudinal axis, said passageways being fluidly interconnected by at least one transverse bore extending essentially perpendicularly to said longitudinal axis and a plurality of fourth passageways opening outwardly along one side of said header from each of said third plurality of passageways; and a core assembly secured between said first and second headers, said core assembly including a plurality of fluid conduits extending between said first and second headers and heat radiating fins surrounding said plurality of fluid conduits, respective ones of said fluid conduits fluidly connecting respective ones of said plurality of second passageways and said plurality of fourth passageways.

16. A heat exchanger as set forth in claim 15 wherein said first and second headers comprise extruded members.

17. A heat exchanger comprising:

a core assembly;

separate first and second one piece headers secured to opposite ends of said core assembly, at least one of said first and second headers including an elongated one piece member having a plurality of substantially parallel longitudinally extending spaced first fluid passageways, each of said first passageways being closed off at opposite ends of said elongated member and second fluid passageways within said at least one of said first and second headers operative to place said first fluid passageways in fluid communication with each other.

18. The heat exchanger of claim 17 wherein said second fluid passageways are formed in said elongated member.

19. The heat exchanger of claim 17 wherein opposite ends of each of said first fluid passageways are closed off by means of plugs sealingly secured therein.

20. The heat exchanger of claim 17 wherein said one of said first and second headers includes a second elongated one piece member having a plurality of substantially parallel longitudinally extending spaced third fluid passageways provided therein, each of said third fluid passageways being closed off at opposite ends thereof and third fluid passageways operative to place said first fluid passageways in fluid communication with each other, opposed ends of said first and second elongated members being secured together.

21. The heat exchanger of claim 17 wherein said first elongated member has an inlet opening communicating with said first fluid passageways provided adjacent said opposed end and said second elongated member has an outlet opening communicating with said third fluid passageways provided adjacent said opposed end.

22. The heat exchanger of claim 21 further comprising a by-pass valve assembly provided on said one header, said by-pass valve assembly being operative to allow fluid to bypass said core assembly when said fluid is below a predetermined temperature and to direct fluid flow through said core assembly when said fluid is at or above a predetermined temperature.

23. The heat exchanger of claim 22 wherein said by-pass valve assembly is also operative to allow fluid to by-pass said core assembly in response to a pressure differential between said inlet and outlet opening above a predetermined pressure.

24. The heat exchanger of claim 22 wherein said by-pass valve assembly is removably secured to said one header.

25. The heat exchanger of claim 24 wherein said one header includes a plate member secured to said first and second elongated members, said plate member including openings aligned with each of said inlet and outlet openings, said by-pass valve assembly being removably secured to said plate member.

26. The heat exchanger of claim 25 wherein said by-pass valve assembly includes a fluid inlet passage communicating with said inlet passage via one of said openings in said plate member, a fluid outlet passage in fluid communication with said outlet passage via another opening in said plate member, a by-pass passage for placing said fluid inlet passage in fluid communication with said fluid outlet passage and a valve member operative to selectively allow and prevent fluid communication between said fluid inlet passage and said fluid outlet passage.

27. The heat exchanger of claim 26 wherein said valve member is responsive to the temperature of said fluid at said outlet opening.

28. The heat exchanger of claim 27 wherein said valve member is also responsive to excessive pressure differential between said inlet and outlet openings.

29. The heat exchanger of claim 17 further comprising a by-pass valve assembly provided on said one header, said by-pass valve assembly being operative to allow fluid to bypass said core assembly when said fluid is below a predetermined temperature and to direct fluid flow through said core assembly when said fluid is at or above a predetermined temperature.

30. The heat exchanger of claim 29 wherein said by-pass valve assembly is removably secured to said one header.

31. The heat exchanger of claim 30 wherein said by-pass valve assembly is also operative to allow fluid to by-pass said core assembly in response to a pressure differential between said inlet and outlet opening above a predetermined pressure.

* * * * *